US005470292A

United States Patent [19]

Simon

[11] Patent Number: 5,470,292

[45] Date of Patent: Nov. 28, 1995

[54] STEP AEROBIC EXERCISE DEVICE

[76] Inventor: Agnes Simon, 87-13 160th St., Jamaica, N.Y. 11432

[21] Appl. No.: 278,982

[22] Filed: Jul. 21, 1994

Related U.S. Application Data

[63] Continuation of Ser. No. 23,340, Feb. 26, 1993, abandoned.

[51] Int. Cl.[6] ..... A63B 22/00

[52] U.S. Cl. ..... 482/52; 482/51; 482/908

[58] Field of Search ..... 482/51, 52, 142, 482/907, 908; 182/223; 52/183; 108/93; 606/243

[56] References Cited

U.S. PATENT DOCUMENTS

| | | | |
|---|---|---|---|
| D. 330,057 | 10/1992 | Saunders et al. . | |
| 2,943,902 | 7/1960 | McMechen | 108/93 |
| 3,641,601 | 2/1972 | Sieg . | |
| 4,253,661 | 3/1981 | Russell . | |
| 4,271,830 | 6/1981 | Moon | 606/243 |
| 4,340,218 | 7/1982 | Wilkinson | 482/52 |
| 5,050,861 | 9/1991 | Thomas et al. . | |
| 5,116,044 | 5/1992 | Wilkinson et al. . | |
| 5,118,096 | 6/1992 | Wilkinson et al. . | |
| 5,118,101 | 6/1992 | Belli . | |
| 5,125,646 | 6/1992 | Wilkinson et al. . | |
| 5,125,647 | 6/1992 | Smith . | |
| 5,162,028 | 11/1992 | Wilkinson | 482/52 |

*Primary Examiner*—Lynne A. Reichard

*Attorney, Agent, or Firm*—Dann, Dorfman, Herrell and Skillman; Henry H. Skillman

[57] ABSTRACT

An exercise device is provided in the form of a central platform having two extensible wings which together with the supporting surface of floor on which the exercise device is supported forms along with the central platform a series of steps. The wings are spring loaded and controllable by a calibrated turnkey which enables the wings to be extended a determinable amount which correlates to the height of the individual using the device for purposes of exercise. To use the device, the exercising individual stands on the central platform and moves his feet from step to step, first down and then up, with the option of alternating between the user's two feet.

17 Claims, 2 Drawing Sheets

STEP AEROBIC EXERCISE DEVICE

This is a continuation of application Ser. No. 08/023,340, filed Feb. 26, 1993 now abandoned.

This invention relates to exercising devices and to methods appertaining thereto.

BACKGROUND

Exercising devices of the same general type as provided in accordance with the instant invention are to be found in U.S. Pat. Nos. Des.330,057; 3,641,601; 4,253,661; 5,050,861; 5,116,044; 5,125,646; 5,125,647; and 5,118,096.

In U.S. Pat. No. Des. 330,057 (Oct. 6, 1992), Saunders et al. disclose an aerobic step bench design. No explanation is given for the use of the same, and it appears that the design consists of a single bench having a single supporting surface.

William F. Sieg reveals in U.S. Pat. No. 3,641,601 (Feb. 15, 1972) an exercising device usable to simulate walking and the like. The device has a base which carries a pad of elastic compressible material, and the pad has a longitudinal slot along the top dividing the pad into separate upwardly extended sections. No adjustment is provided with respect to the resulting surfaces.

Brian Russell reveals in U.S. Pat. No. 4,253,661 (Mar. 3, 1981) a thick, flexible pad with a sloped top surface and sloped sides which provides for leg exercises involving running, squatting, and so forth.

In U.S. Pat. No. 5,050,861, Laurie Thomas discloses an adjustable bench-step for use in exercising. This device is provided with an upper platform which is insertable into a base with the upper platform being adjustable vertically and being approachable from any horizontal axis. This device does not actually show adjustable steps as will be disclosed in connection with the instant invention hereinbelow.

W. Wilkinson reveals in U.S. Pat. No. 5,116,044 an aerobic climbing step-bench. This device includes a base consisting of a horizontal platform with a plurality of spaced legs mounted on the base to support the same. Each of the legs is detachably mounted so as to be movable from an active position to a stored condition. This device similarly fails to reveal adjustable steps as will be found in connection with the instant application.

W. Wilkinson furthermore reveals in U.S. Pat. No. 5,125,646 another aerobic step/bench exercise device which includes a base supported on a plurality of spaced legs and arranged such that the platform is capable of being disposed at a plurality of elevations. Aside from this adjustment of elevations, no provision is made for adjustments of related steps.

In U.S. Pat. No. 5,125,647, Robert Smith shows a jump platform exerciser in which a cantilever type platform is monitored electronically for the counting of pulses. By such means, a signal results representing a number of pulses emitted from a clock corresponding to a timing period. No adjustment of steps is provided by this patent.

W. Wilkinson shows furthermore in U.S. Pat. No. 5,118,096 an aerobic climbing step/bench in which a platform is supported by a plurality of detachable legs. This provides for adjusting the overall height of the platform but does not provide for adjusting of steps in the manner which will be described hereinbelow.

In U.S. Pat. No. 5,118,101, Raymond Belli shows a plyometric platform in which adjustment is provided to a plurality of positions thereby providing for the adjustment of steps, but this adjustment is wholly unlike the adjustment provided for in accordance with the present invention, as will be discussed in detail hereinbelow.

SUMMARY OF THE INVENTION

It is an object of the invention to provide an improved exercising device and method.

It is another object of the invention to provide an improved exercising device having a plurality of adjustable width selections.

Still another object of the invention is to provide an improved exercising device which is compact and adjustable to a readily stored condition.

It still another object of the invention to provide an improved means and method for the exercise of various muscles of the human physique.

To achieve the above and other objects of the invention, there is provided an exercise apparatus comprising a platform with extensible members being extendible in different directions from this platform. Furthermore, an arrangement is provided to control the extension of the extensible members from the aforesaid platform. Preferably, the aforementioned members are extensible in opposite directions from the platform and these members have substantial coplanar supporting surfaces adapted for respectively receiving the feet of an exercising individual. The platform moreover has a supporting surface which is located at a higher level than these coplanar supporting surfaces. Furthermore, the members are at least partly accommodated within the platform. In addition to the foregoing, the aforesaid arrangement includes a pivotal camlike element interposed between the members to control the extension thereof. Furthermore, there may be provided a spring arrangement to spring load the members to bear against the cam-like elements to enable the control of these extensible members. These members and preferably the platform also include a shock absorbing skid proof material at the aforementioned surfaces. Moreover, the platform, which is preferably a central platform having generally quadrilateral profile, will be provided at its lower surface with a skid proof material.

The platform as noted above, which is preferably of quadrilateral shape, which is of preferably dimensions in the order of magnitude of 24 inches long by 16 inches wide. The platform is centrally located between the supporting surfaces of the aforementioned members. As a feature of the invention may be provided a calibrated turnkey coupled to the cam-like member for pivoting the same for purposes of controlling the extension of the extensible members.

In a preferred embodiment, the platform is in the order of magnitude of 6 inches in height, The members which provide the wings are for example, in the order of magnitude of 3 inches in height or, in other words, approximately about half the height of the entire device. The members may preferably be in the order of magnitude of 12 inches in length and 12 inches in width. The key is calibrated to extend the members in equal increments.

In accordance with the method provided in accordance with the invention, such method comprises controllably extending wings out of a platform to form steps above a supporting surface, standing on the platform with both feet, and moving the feet of the exercising individual respectively and selectively down and up the aforesaid steps.

The aforesaid wings may be extended according to the height of the exercising individual, and these wings are preferably extended in the order of magnitude of from 0 to 6 inches selectively.

The above and other objects, features, and advantages of the invention will be found in the following detailed description as illustrated in the accompanying drawing.

DETAILED DESCRIPTION

The exercising device of the invention is an aerobic apparatus which is intended to provide for strengthening the legs and feet of a user. More specifically, there is provided in accordance with the invention a portable device for use in aerobic step climbing routines and programs. This device generally comprises a base or plateau otherwise known as a central platform which may, for example, have a dimension of 24 inches in length by 16 inches in width. It is preferably made of wood, plastic, fiber glass, plywood, metal, or other suitably durable materials and is covered with a skidproof material such as for example natural or synthetic rubber or a suitable plastic or paint. Between the wood and the skid proof material is a shock absorbent material which, for example, is a natural or synthetic material of sponge, compressible pads, vinyl or silicone foam, foam rubber, flexible foam, canvas, fabric, leather, foam carpet, polyurethane, or other similar materials. As will be shown, under the central platform, there are springs to assist in adjusting the extension of the wings. Also, there can be used rounded wooden, metal or plastic rods. Hardware such as bolts, clips, latches, adjustable rods, or tracks or various other adjustable devices that can accommodate the shortening and lengthening of the right and left wings can also be used. A calibrated turnkey for adjusting the range of extension of the wings through a series of increments starting at zero and increasing in 1 inch magnitudes through a maximum extension as, for example, 6 inches is provided. The adjustments are made by the turnkey to suit the height of the individual exerciser and, therefore, in accordance with the leg lengths of the exerciser. Such adjustment is made before the device of the invention is used.

The central platform of the device may, for example, be in the order of magnitude of 6 inches above the supporting surface or floor. It is, as has been noted hereinabove, covered with a shock absorbing skid-resistant surface which is tapered with rounded edge on the right and left edge of the plateau. The central platform drops by, for example, 3 inches on the right and left sides of the same. The extension wings are, for example, 12 inches in length by 12 inches in width, and the supporting surfaces thereof are, for example, 3 inches in height, or approximately one-half the height of the entire device. The auxiliary wings are also covered with a shock absorbing and skid proof material.

Figure 2:
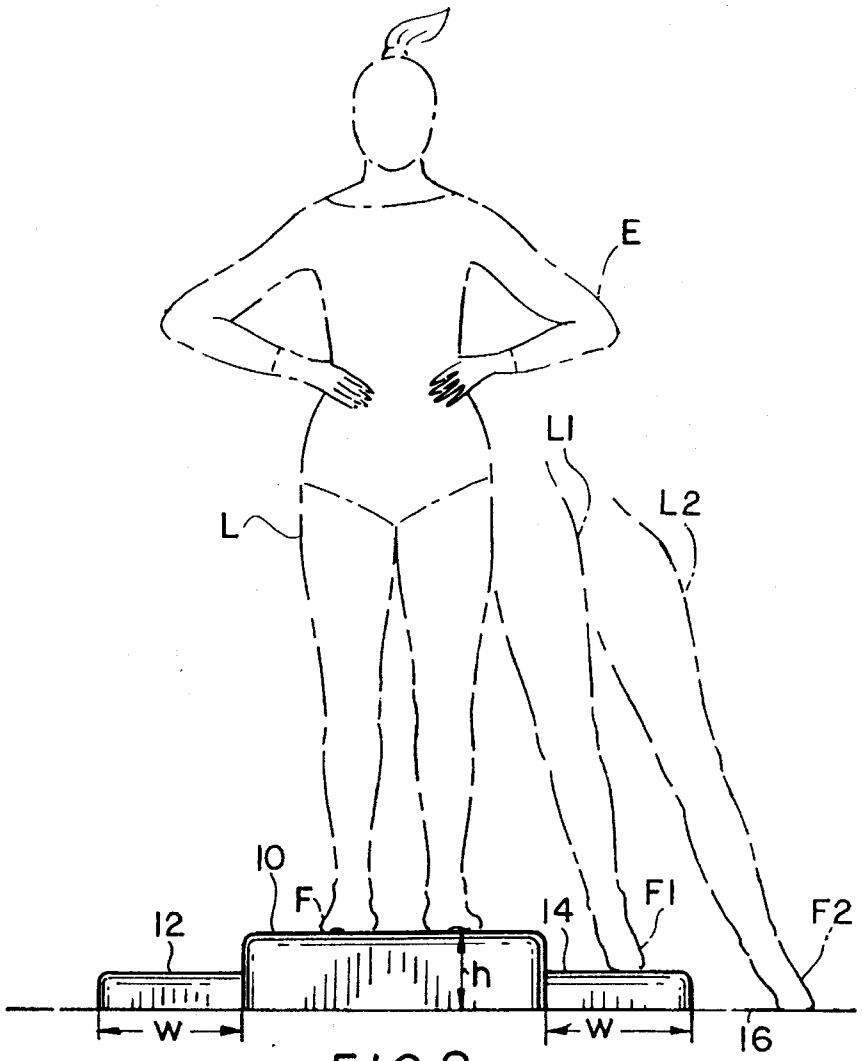
FIG. 2 illustrates the individual of FIG. 1 in various postures of utilization of the exercising device of the invention.
Figure 1:
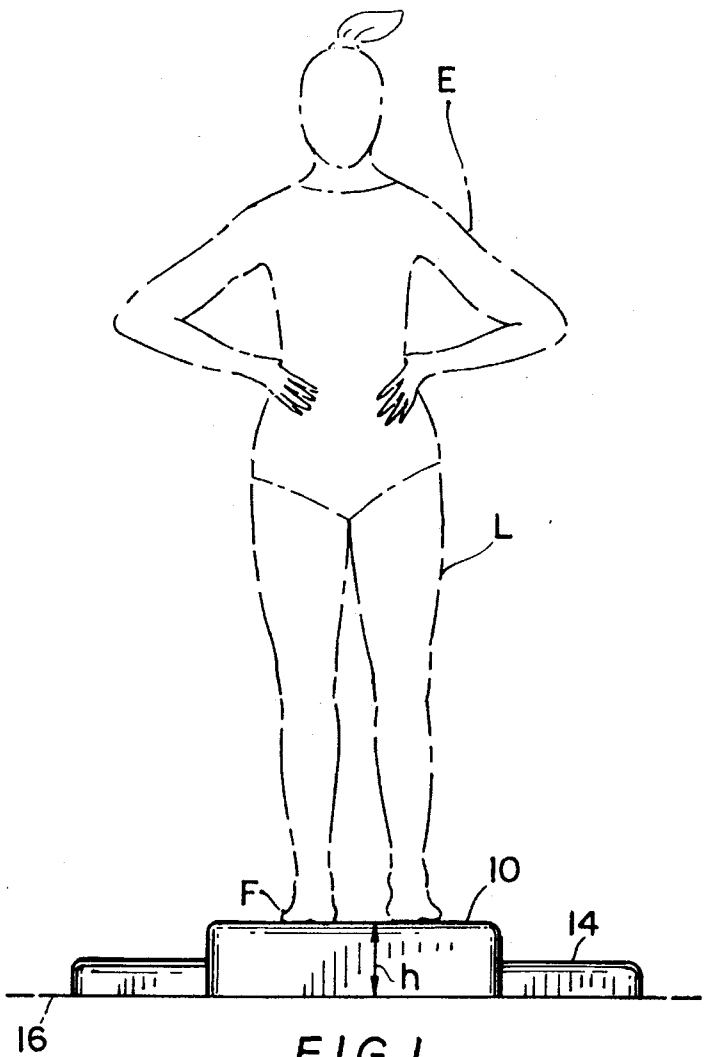
FIG. 1 diagrammatically illustrates an individual exercising on a device provided in accordance with the invention.

In FIGS. 1 and 2 is shown an exercising individual E having legs L and feet F supported on a central platform 10. The central platform 10 has a height h which, as stated hereinabove, may be in the order of magnitude of about 6 inches. Also shown in FIGS. 1 and 2 are extensible wings or members 12 and 14 having useful widths w in the order of magnitude of 0 to 6 inches. Actually, these wings have a greater width because they extend into and are partially accommodated in the interior of the central platform 10, which consists of a wooden or plastic form covered by suitable material and provided with such bracing as to be able to support a wide range of weights which may be ascribable to exercising individuals using this apparatus. It is a simple, light weight, portable and a convenient device weighing between 15 lbs and 20 lbs for easy transportation and storage. It can be used by all age groups in all walks of life.

FIG. 2 illustrates that the legs of the exercising individual as indicated at L1 and L2 may be moved laterally so that the feet of the individual as shown at F1 and F2 descend down the steps constituted by the different supporting surfaces until coming to rest on the floor or supporting surface 16, whereupon the operation is reversed and the legs are so moved that the feet ascend the steps constituted by the supporting surfaces. The supporting surfaces of members 12 and 14 are preferably coplanar and below the height of the supporting surface provided by the central platform 10.

Figure 3:
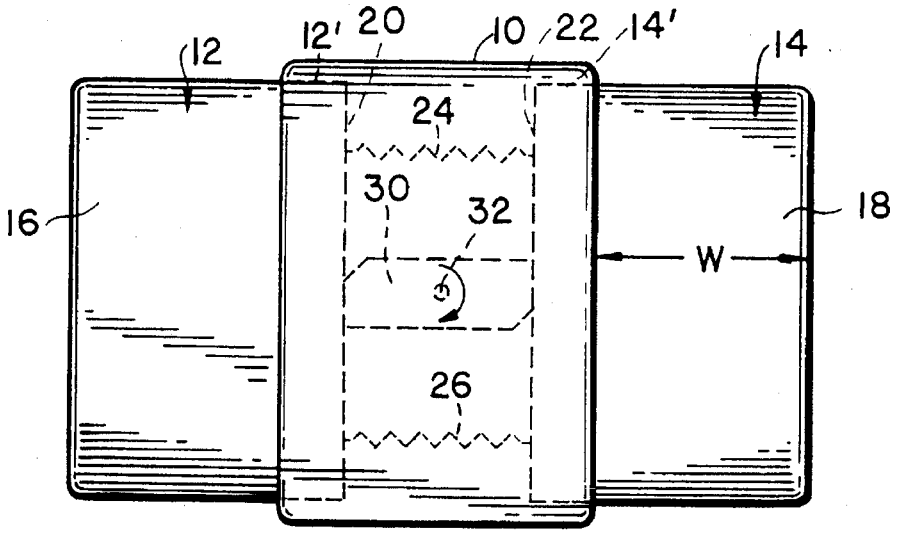
FIG. 3 is a diagrammatic top view of an embodiment of the invention illustrating the central platform with the wings extended.
Figure 4:
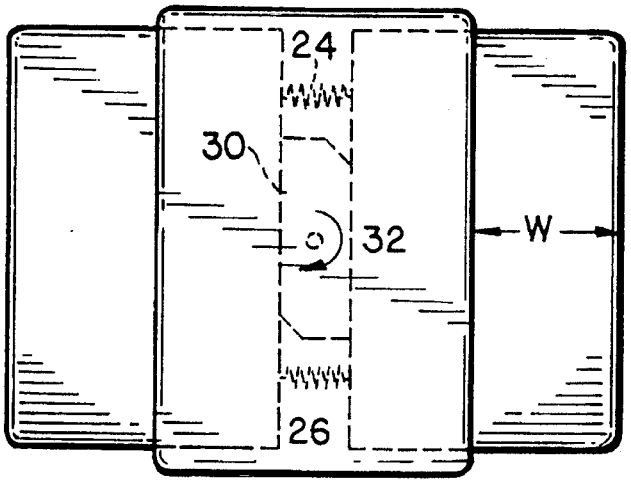
FIG. 4 is a view corresponding to FIG. 3 with the wings retracted into the central platform.

FIGS. 3 and 4 illustrate the members or wings 10 and 12 and furthermore show the supporting surfaces 16 and 18 thereof and the effective width w thereof. As will be seen, the portions 12' and 14' of the wing members extend internally into the interior of the central platform or plateau 10. Between the inner edges of these wings as indicated at 20 and 22 are accommodated springs 24 and 26. These springs diagrammatically illustrate that the wings are spring loaded in such a manner as to be drawn into the interior of the central platform 10.

Also illustrated in FIGS. 3 and 4 is a central cam-like member 30 pivotal on an axis 32 which represents a calibrated turnscrew adapted for adjusting the extension of the extendible members 16 and 18 according to a selected series such as, for example, 0–1–2–3–4–5–6 inches. Thus, the extension driving out of the wings can be effected in equal increments although the magnitude and number of these increments may be selected as desired to accommodate ergonometrically the type of user who will purchase and use the exercising device of the invention.

Figure 5:
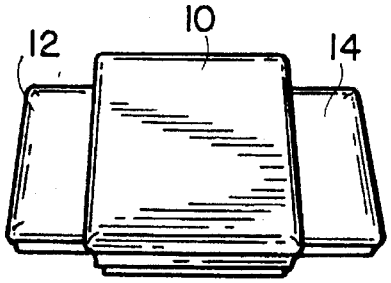
FIG. 5 is a front perspective view of an exercising device provided in accordance with the invention and corresponding to the illustrations of FIGS. 3 and 4.

FIG. 5 illustrates in perspective view the central platform 10 and extensible wings 12 and 14 of the exercise device of the invention. As the upper surface is covered by a shock absorbing and skid-resisting material, it will be apparent that access to the pivotable cam may be effected through the bottom of the device.

All muscles of the leg and foot are used. The main muscles include the gluteus medius, the gluteus maximus, the adductor magnus, the biceps femoris, the semitendinosus, the semimembranosus, the gastrocnemius, the soleus, the peroneus longus, the tensor fasciae latae, the pectineus, the adductor longus, the adductor magnus, the gracilis, the vastus medialis, the vastus lateralis, the peroneus longus, the extensor digitorum longus, the tibialis anterior, the achilles tendon, and the tendon of peroneus longus. For this exercise to be effective, an individual between 4 feet and 5 feet high should use the gauge range of 0–1–2 inches. Someone between 5 feet and 5 feet 6 inches should use the gauge range of 3 and 4 inches and then from 5 feet 7 inches to 6 feet 5 inches and above, one should use a gauge range of 5 and 6, which makes the right and left step 6 inches away from the initial position, which is set on zero.

From the above, it will be seen that there is provided an exercising method which comprises controllably extending wings out of a platform to form steps above a supporting surface such as a floor. The individual who is exercising stands on the platform with both feet and moves these feet respectively and selectively down and up the steps. The wings are extended according to the height of the individual and more particularly are extended in equal increments through a range of from 0 to 6 inches selectively by way of example. This range of extension may be varied according to need, but it should be noted that the extension is generally in accordance with the height of the exercising individual as well as the length of the individual's legs.

A person using the device of the invention operates by standing on the central platform with both feet and keeping the body in an upright neutral alignment or posture, then moving the feet from the central platform to the respective wings, and then onto the floor and then reversing the action from the floor to the wing and back to the central platform. One can also move the feet from the central platform to the floor missing the wing and return back to the central platform. The exercising party can also use the central platform by moving the feet from the platform to the floor in front of the platform and by then reversing the action. Such person can also use the central platform by moving the feet from the platform to the floor behind the platform and reversing the action. One can do, for example, 20 minutes of these repetitions for each of the legs to develop muscles, strength, balance, coordination, flexibility, endurance, and stamina. This type of workout can be used as a good leg extension exercise, a total aerobic workout and a cardiovascular workout. One can also use the platform to elevate one's feet when doing situps and abdominal crunches and twist. The arms are either extended at the sides or placed on the waist for balance. To help in sculpturing the upper body, one can incorporate hand weights when doing the step exercise. The added strength may help prevent knee and bodily injuries and give one added stamina. This device is good for runners, dancers, walkers, swimmers, cyclists, and all ball playing athletes. The device can be used by a physical and physio therapists for strengthening bones, muscles, and tendons and overall toning of feet, ankles, knees, and legs.

There will now be obvious to those skilled in the art many modifications and variations of the structure and method set forth hereinabove. These modifications and variations will not depart from the scope of the invention if defined by the following claims.

What is claimed is:

1. Exercise apparatus adapted to be mounted on a floor, comprising a platform, extensible members extendible from said platform, and adjusting means to control the extension of said extensible members from said platform, said members being extensible in opposite directions from said platform and having substantially coplanar supporting surfaces adapted for respectively receiving the feet of an exercising person, said platform having a supporting surface located at a selected fixed distance above the floor twice the height of said coplanar supporting surfaces, said members being at least partly accommodated within said platform, said means including an element interposed between said members to adjust the extension of said members in increments to different selectable extents, said coplanar supporting surfaces of said members, and said supporting surface of said platform forming steps.

2. Exercise apparatus as claimed in claim 1 wherein said members and platform include a shock absorbent skid-proof material at said surfaces.

3. Exercise apparatus as claimed in claim 1 wherein said members and platform have generally quadrilateral profiles.

4. Exercise apparatus as claimed in claim 1 wherein said platform includes a skid-resistant bottom surface section.

5. Exercise apparatus as claimed in claim 1 wherein said platform is of a generally quadrilateral shape which is about in the order of magnitude of twenty-four inches long and sixteen inches wide.

6. Exercise apparatus as claimed in claim 1 wherein said platform is centrally located between the supporting surfaces of said members.

7. Exercise apparatus as claimed in claim 1 wherein said platform is in the order of magnitude of six inches high.

8. Exercise apparatus as claimed in claim 7 wherein said members are in the order of magnitude of three inches high.

9. Exercise apparatus as claimed in claim 1 wherein said members are in the order of magnitude of twelve inches long and twelve inches wide.

10. Exercise apparatus comprising a central platform adapted to be mounted at a selected height above a floor for receiving the feet of an exercising person, extensible members extendible in different directions from said platform to form steps between the platform and the floor, and adjusting means to drive the extensible members from the platform to control the extension of said extensible members from said platform in increments to different selectable extents.

11. Exercise apparatus as claimed in claim 10 wherein said members are extensible in opposite directions from said platform and are engaged by said adjusting means to be forced by the same in said directions which are opposite one another.

12. Exercise apparatus as claimed in claim 11 wherein said members have substantially coplanar supporting surfaces adapted for respectively receiving the feet of said exercising person.

13. Exercise apparatus as claimed in claim 12 wherein said platform has a supporting surface located at a higher level than said coplanar supporting surfaces, said coplanar supporting surfaces being approximately one-half the height of the platform surface.

14. Exercise apparatus as claimed in claim 13 wherein said members comprise two step members at least partly accommodated with said platform and extendible from the platform by said adjusting means equally from opposite sides of the platform.

15. Exercise apparatus, comprising a platform, extensible members extendible from said platform, and means including an adjusting cam element interposed between said members to control the extension of said extensible members from said platform, and spring means to spring load said members to bear against said cam element, said members being extensible in opposite directions from said platform and having substantially coplanar supporting surfaces adapted for respectively receiving the feet of an exercising person, said platform having a supporting surface located at a higher level than said coplanar supporting surfaces, said members being at least partly accommodated within said platform.

16. Exercise apparatus, comprising a platform, extensible members extendible from said platform, a pivoted element interposed between said members to control the extension of said extensible members from said platform, and a calibrated turnkey coupled to said pivoted element for pivoting the latter, said members being extensible in opposite directions from said platform and having substantially coplanar supporting surfaces adapted for respectively receiving the feet of an exercising person, said platform having a supporting surface located at a higher level than said coplanar supporting surfaces, said members being at least partly accommodated within said platform.

17. Exercise apparatus as claimed in claim 16 wherein said turnkey is calibrated to extend said members in equal increments.

* * * * *